US005464117A

United States Patent [19]

Balsimo

[11] Patent Number: 5,464,117

[45] **Date of Patent: * Nov. 7, 1995**

[54] SEPARATION-SCIENCE MEMBRANE DISPENSER

[75] Inventor: William V. Balsimo, Afton, Minn.

[73] Assignee: Minnesota Mining and Manufacturing Company, St. Paul, Minn.

[ * ] Notice: The portion of the term of this patent subsequent to Jan. 24, 2112, has been disclaimed.

[21] Appl. No.: 347,897

[22] Filed: Dec. 1, 1994

Related U.S. Application Data

[63] Continuation of Ser. No. 971,357, Nov. 4, 1992, Pat. No. 5,383,573.

[51] Int. Cl.[6] ..... B65G 59/06; B65H 3/24; B01D 39/18

[52] U.S. Cl. ..... 221/1; 221/263; 221/264; 210/500.36; 210/505

[58] Field of Search ..... 221/1, 257, 263, 221/264, 197; 414/789.5; 210/653, 500.21, 500.36, 505, 502.1, 636, 238, 232

[56] References Cited

U.S. PATENT DOCUMENTS

| | | | |
|---|---|---|---|
| 1,949,677 | 3/1934 | Crawford | 150/52 |
| 2,180,916 | 11/1939 | Steuernagel et al. | 221/264 |
| 2,482,322 | 9/1949 | Cortese | 215/12 |
| 2,493,616 | 1/1950 | Burns | 206/42 |
| 2,567,089 | 9/1951 | Walsh | 206/42 |
| 2,774,470 | 12/1956 | Q'Part | 221/264 |
| 3,115,992 | 12/1963 | Menolasino et al. | 221/264 |
| 3,410,385 | 11/1968 | Freet et al. | 194/39 |
| 3,424,294 | 1/1969 | Felstehausen | 414/789.5 |
| 3,446,543 | 5/1969 | Matthews | 312/42 |
| 3,467,277 | 9/1969 | Tolliver | 221/264 |
| 4,004,719 | 1/1977 | Weitzman | 222/366 |
| 4,043,916 | 8/1977 | Wecker | 210/238 |
| 4,216,878 | 8/1980 | Naud | 221/264 |
| 4,413,750 | 11/1983 | Morrone et al. | 221/263 |
| 4,619,376 | 10/1986 | Huss | 221/243 |
| 4,792,057 | 12/1988 | Mizer et al. | 221/187 |
| 4,810,381 | 3/1989 | Hagen et al. | 210/502.1 |
| 4,840,838 | 6/1989 | Wyss | 210/500.36 |
| 4,902,423 | 2/1990 | Bacino | 210/500.36 |
| 4,981,591 | 1/1991 | Ostreicher | 210/505 |
| 5,071,610 | 12/1991 | Hagen et al. | 210/502.1 |
| 5,104,632 | 4/1992 | Douden et al. | 210/502.1 |
| 5,158,680 | 10/1992 | Kawai et al. | 210/510.36 |
| 5,171,439 | 12/1992 | Vakharia | 210/510.36 |
| 5,383,573 | 1/1995 | Balsimo | 221/263 X |

FOREIGN PATENT DOCUMENTS

| | | | |
|---|---|---|---|
| 3143953 | 5/1983 | Germany | B65D 83/04 |
| 1604037 | 12/1981 | United Kingdom | B65D 25/52 |

OTHER PUBLICATIONS

Nuclepore™ Corporation product literature for Membra-Fil™ and Filinert™ Membranes.

Whatman International Ltd. product literature for glass microfiber filter.

Empore™ Extraction Disks product literature.

*Primary Examiner*—William E. Terrell
*Assistant Examiner*—Dean A. Reichard
*Attorney, Agent, or Firm*—Gary L. Griswold; Walter N. Kirn; Karl G. Hanson

[57] ABSTRACT

A separation-science disc dispenser (10) has a storage chamber (12) disposed normally to a base (20) that possesses a slot (24) into which a slidable member (26) resides. The storage chamber (12) contains disc units (14) that include a separation-science membrane (16) and a protective liner (18). Where the storage chamber (12) meets the base (20), there is an opening (30) in the storage chamber that allows disc units (14) to exit the storage chamber. The slidable member has a cavity (28) sized to receive a single disc unit (14) from the storage chamber (12) when the cavity (28) is in register with the opening (30). Drawing the slidable member (26) outward from slot (24) causes a single disc unit (14) to be discharged in a non-contaminated condition from the dispenser (10).

2 Claims, 2 Drawing Sheets

SEPARATION-SCIENCE MEMBRANE DISPENSER

This is a continuation of application Ser. No. 07/971,357 filed Nov. 4, 1992, now U.S. Pat. No. 5,383,573.

TECHNICAL FIELD

This invention pertains to a device and method for dispensing separation-science membranes in non-contaminated condition.

BACKGROUND OF THE INVENTION

In the separation-science art, there often is a need to dispense separation-science membranes in a manner that prevents them from being contaminated. This need is particularly pronounced when the separation-science membrane is a sorptive membrane such as a polytetrafluoroethylene (PTFE) disc or cellulosic membrane. Sorptive membranes must be handled with care to avoid sorbing compounds that would taint the separation analysis. In spite of this need for avoiding contamination, separation-science membranes, including sorptive membranes, often are packaged in a manner that requires the membranes to be physically lifted from the container by the user's fingers or by use of a small instrument such as tweezers. The Nuclepore™ Corporation (Pleasanton, Calif.) places its PTFE (Filinert™) and cellulosic (Membra-Fil™) discs in plastic containers that have a recessed storage chamber. To facilitate removal of an individual disc, a sidewall of the recessed storage chamber opens into a cavity that provides space for a person to insert their finger or a tool to grip an individual disc. Whatman International Ltd. (Maidstone, England) and others use similar containers to store and dispense their separation-science media.

Apparatuses have been disclosed that dispense tablets, bingo chips, and other discs without having to physically lift each disc from its storage compartment. Examples of such apparatuses are shown in U.S. Pat. Nos. 4,792,057, 4,619,376, 4,413,750, 4,216,878, 4,004,719, 3,467,277, 3,410,385, 3,115,992, 2,567,089, and 2,493,616. U.S. Pat. No. 2,493,616 published in 1946, in particular, discloses a portable dispensing unit 10 that obviates the necessity of a person touching the tablets with his hands. The device as shown in FIG. 1 of that patent has a body portion 11 that has a storage chamber 12. A sliding cover 18 has a pocket 19 for receiving a tablet 28 from chamber 12 when the pocket is in communication with the chamber. By sliding the cover 18 to expose the pocket 19, a tablet 28 can be discharged from the dispensing unit 10.

SUMMARY OF THE INVENTION

The present invention provides a separation-science membrane dispenser that comprises: (a) a storage chamber that contains a plurality of disc units wherein each disc unit includes a separation-science membrane and a protective liner, there being located at a base of the storage chamber an opening sized to permit the disc unit to exit the storage chamber; and (b) a slidable member containing a cavity sized to receive a single disc unit when the cavity is positioned in register with the opening at the base of storage chamber, the slidable member having the capacity to be slid from the register position to a dispensing position to dispense a single disc unit upon each movement of the slidable member from the register position to the dispensing position.

The present invention also provides a method of dispensing separation-science membranes, which comprise the steps: (a) storing a plurality of disc units that each include a separation-science membrane and a protective liner in an apparatus that comprises a storage chamber and a slidable member, wherein the disc units are stored in the storage chamber and there is an opening at a base of the storage chamber which communicates with a cavity of the slidable member when the slidable member is in register with the opening; and (b) dispensing the disc units from the storage chamber at single disc unit increments by moving the slidable member from the register position to a dispensing position.

The present invention is advantageous over prior art separation-science containers in that the separation-science membranes can be readily removed from the container without having to physically lift each individual membrane therefrom. By providing a slidable member that contains a cavity sized to receive a membrane and a protective liner, and dispensing the same as a single unit, a separation-science membrane can be placed directly onto a filtration or extraction apparatus without risking contamination of the membrane.

This and other advantages of the invention are more fully shown and described in the drawings and detailed description of this invention, where like reference numerals are used to represent similar parts. It is to be understood, however, that the description and drawings are for the purposes of illustration only and should not be read in a manner that would unduly limit the scope of this invention.

DETAILED DESCRIPTION OF THE PREFERRED EMBODIMENTS

In describing preferred embodiments of the invention, specific terminology will be used for the sake of clarity. The invention, however, is not intended to be limited to the specific terms so selected, and it is to be understood that each term so selected includes all the technical equivalents that operate similarly.

Figure 1:
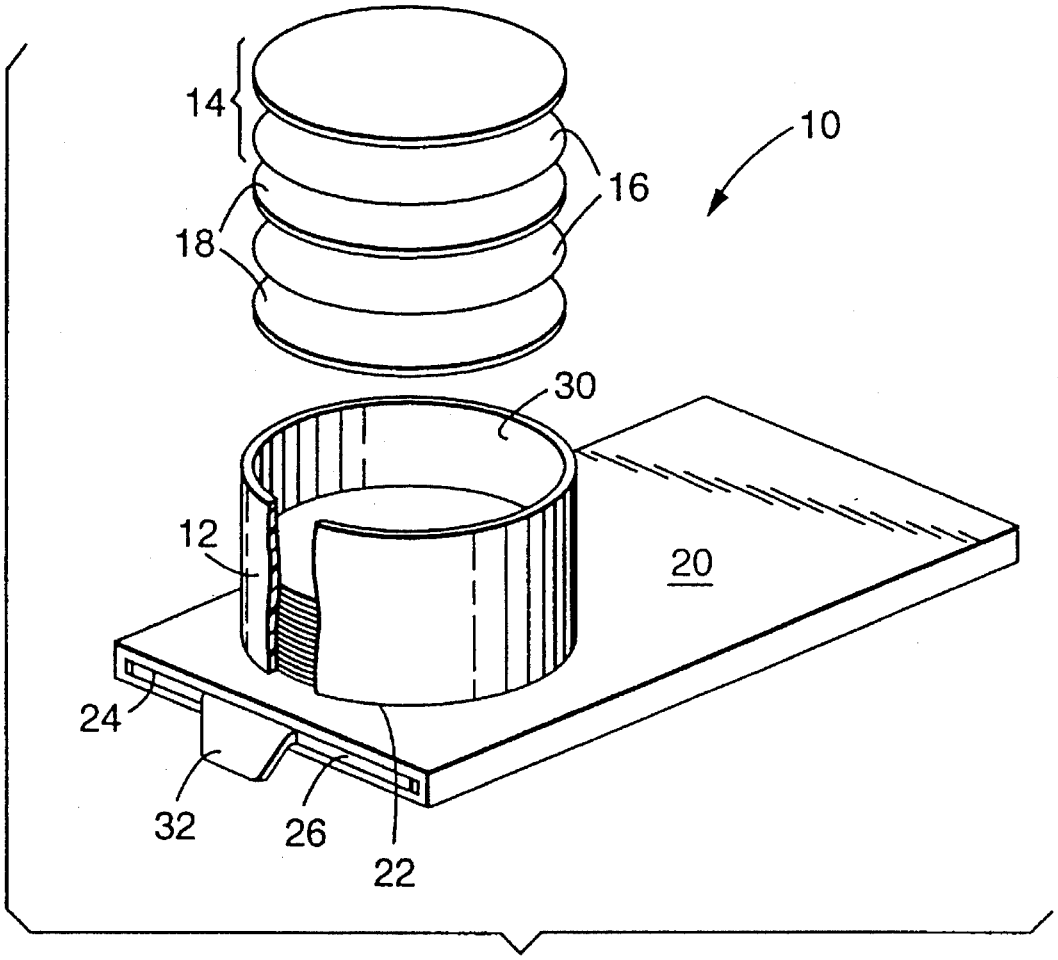
FIG. 1 is a perspective view of a separation-science membrane dispensing apparatus 10 in accordance with the present invention.
Figure 2:
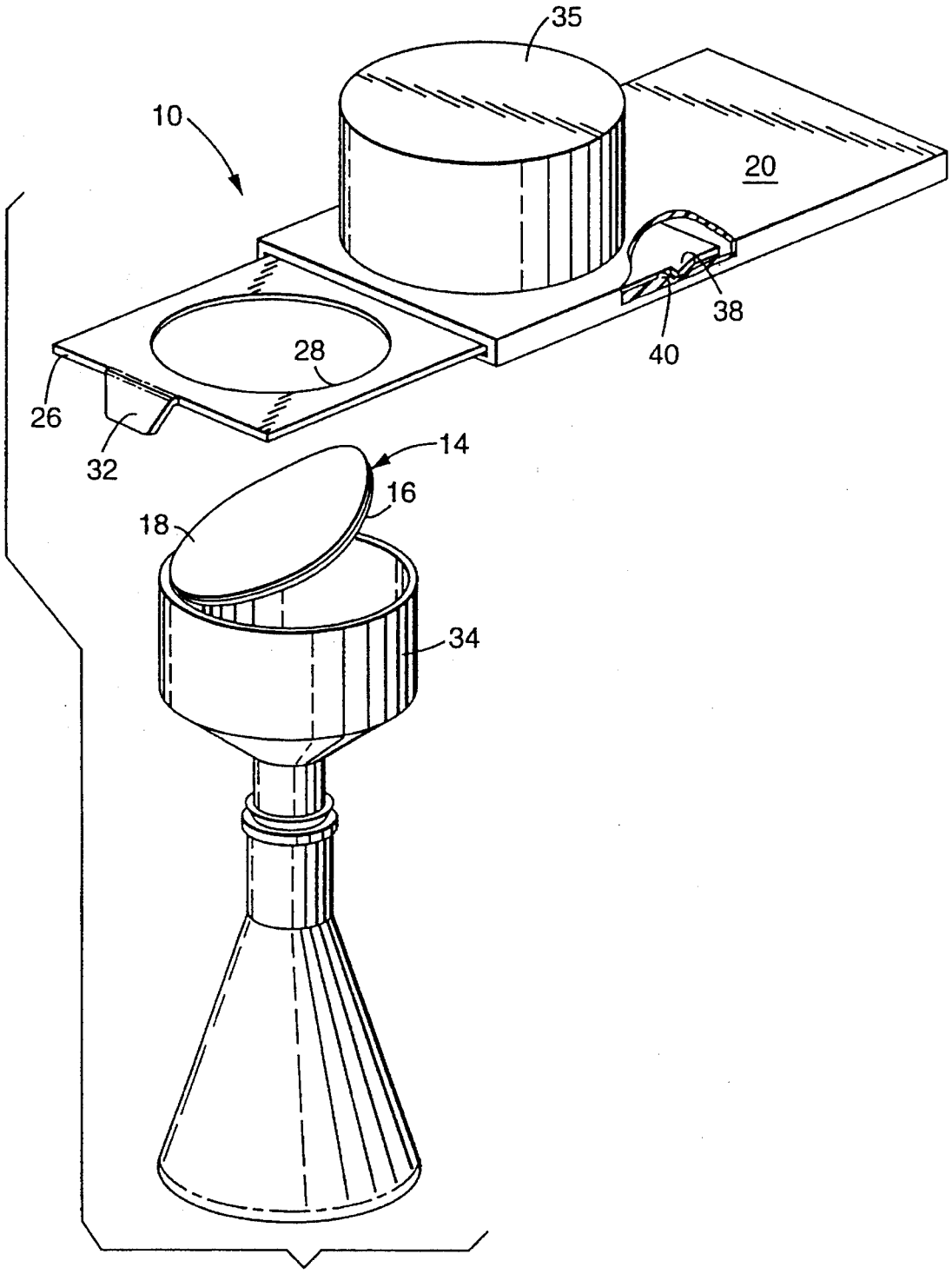
FIG. 2 is a perspective view of a separation-science membrane dispensing apparatus 10 in accordance with the present invention, illustrating the disk unit 14 being dispensed therefrom.

Referring to FIGS. 1 and 2, a separation-science membrane dispenser 10 is illustrated which has a storage chamber 12 that contains a plurality of disc units 14 stacked concentrically. Each disc unit 14 includes a separation-science membrane 16 and a protective liner 18. A base 20 is located at a first end 22 of the storage chamber 12 and has a slot 24 extending normal to storage chamber 12. Slot 24 receives a slidable member 26 that is capable of moving in first and second opposite directions parallel to slot 24. Slidable member 26 has a cavity 28 for receiving a disc unit 14 when the cavity 28 is in register with an opening 30 located at the first end 22 of storage chamber 12.

FIG. 1 illustrates the slidable member 26 positioned in slot 24 such that the cavity 28 is in register with the opening 30. A tab 32 is provided on slidable member 26 to slide member 26 in a direction parallel to slot 24. To dispense a disc unit 14 that has entered cavity 28, the user draws slidable member 26 outward to transfer the disc unit 14 in cavity 28 of slidable member 26 from the register position (FIG. 1) to the dispensing position (FIG. 2). Disc units 14 can be fed into cavity 28 by gravity or other means such as spring (not shown) located in storage chamber 12.

The separation-science membrane dispenser 10, preferably, is portable so that it can be placed immediately over a filter holder 34 so that the disc unit can be discharged directly therein or thereon. Disc units 14 are preferably stacked in storage chamber 12 such that when a disc unit is discharged from the dispenser 10, the protective liner 18 resides above the separation-science membrane 16. This enables the protective liner 18 to protect the separation-science membrane 16 from contamination until it is used in performing a separation technique. Dispenser 10 can have a cover 35 to provide an enclosed dispenser to further protect the disks from contamination. When the disc units are spring fed into cavity 28, the spring can be disposed in chamber 12 between cover 35 and the stack of disc units.

As shown in FIG. 2, the cavity 28 of slidable member 26 is adapted so that it dispenses a single disc unit. This is accomplished by having cavity 28 sized to receive a single disc unit when the cavity is placed in register with the opening 30 of storage chamber 12. Cavity 28 thus has a depth that is substantially equal to the thickness of a single disc unit. Although cavity 28 is illustrated as an opening in FIG. 2, it may also take the form of a recessed region in slidable member 26.

Slidable member 26 has means for preventing the member from being drawn completely out of slot 20. Such a means may take the form of a flange 38 projecting from an edge of slidable member 26. Flange 38 may engage a dimple or other protuberance 40 in slot 24 to prevent further transverse movement of slidable member 26.

The separation-science membranes that are employed in this invention typically are circular in shape. Although the term "disc" is normally used to describe an object with such a shape, it is to be understood that the term disc is used herein to include sheet-like membranes of other shapes including rectangles, ellipses, etc. As the term "separation-science membrane" is used herein, it means any item, such as a filter, membrane, or other medium or combination of media, which is used in the scientific, and especially the chemical and biological fields, in the art of separation, isolation, purification, identification, and the like or combinations thereof. Separation-science membranes include: any presently known or later developed filters; solid-phase extraction discs including PTFE sorptive media such as Empore™ extraction discs available from 3M Company (St. Paul, Minn.) and Nuclepore™ Filinert™ membranes; and cellulosic membranes comprised of cellulose acetate and cellulose nitrate such as Membra-fil™ also available from Nuclepore™. A preferred sorbent membrane is a PTFE fibril matrix having non-swellable sorptive particles enmeshed therein such as disclosed in U.S. Pat. Nos. 4,971,736, 4,906,378, and 4,810,381, the disclosures of which are incorporated here by reference.

A protective liner 18 of this invention can include any sheet-like material that is capable of protecting the separation-science membrane from contamination. When the separation-science membrane is a sorptive media such as a solid-phase extraction disc, the protective liner should be made from a compatible material; that is, a material that is not sorbed onto the PTFE membrane to contaminate the same. Examples of protective liners that may be suitable include PTFE paper, white bond paper, parchment, and a variety of plastic coated papers.

Various modifications and alterations of this invention will become apparent to those skilled in the art without departing from the scope and spirit of this invention. It therefore should be understood that this invention is not unduly limited to the illustrative embodiments set forth above, but is to be controlled by the limitations set forth in the claims and equivalents thereof.

What is claimed is:

1. In combination, a separation-science membrane and a dispenser therefor, the combination comprising:

(a) a storage chamber that contains separation-science membranes, there being located at a base of the storage chamber an opening sized to permit the separation-science membranes to exit the storage chamber; and (b) a slidable member containing a cavity sized to receive a separation-science membrane when the cavity is positioned in register with the opening at the base of the storage chamber, the slidable member having the capacity to be slid from the register position to a dispensing position to dispense a separation-science membrane upon each movement from the register position to the dispensing position.

2. A method of dispensing a separation-science membrane, which comprises:

(a) storing a separation-science membrane in an apparatus that comprises a storage chamber and a slidable member that has a cavity located therein, wherein the separation-science membrane is stored in the storage chamber and there is an opening at a base of the storage chamber which communicates with the cavity of the slidable member when the slidable member is in register with the opening; and (b) dispensing the separation-science membrane from the storage chamber by moving the slidable member from the register position to a dispensing position.

* * * * *